US006761470B2

(12) United States Patent
Sid

(10) Patent No.: US 6,761,470 B2
(45) Date of Patent: Jul. 13, 2004

(54) CONTROLLER PANEL AND SYSTEM FOR LIGHT AND SERIALLY NETWORKED LIGHTING SYSTEM

(75) Inventor: Alberto Sid, Upper Saddle River, NJ (US)

(73) Assignee: Lowel-Light Manufacturing, Inc., Brooklyn, NY (US)

( * ) Notice: Subject to any disclaimer, the term of this patent is extended or adjusted under 35 U.S.C. 154(b) by 0 days.

(21) Appl. No.: 10/072,273

(22) Filed: Feb. 8, 2002

(65) Prior Publication Data

US 2003/0151909 A1 Aug. 14, 2003

(51) Int. Cl.[7] ..... F21S 10/00
(52) U.S. Cl. ..... 362/233; 362/260; 315/312
(58) Field of Search ..... 362/233, 260, 362/268, 277, 319; 315/312

(56) References Cited

U.S. PATENT DOCUMENTS

| | | | | |
|---|---|---|---|---|
| 4,358,715 A | | 11/1982 | Dinges et al. | |
| 4,392,187 A | | 7/1983 | Bornhorst | |
| 4,947,302 A | | 8/1990 | Callahan | |
| 4,980,806 A | | 12/1990 | Taylor et al. | |
| 5,059,871 A | | 10/1991 | Pearlman et al. | |
| 5,072,216 A | | 12/1991 | Grange | |
| 5,101,141 A | | 3/1992 | Warner et al. | |
| 5,245,705 A | | 9/1993 | Swaney | |
| 5,329,431 A | | 7/1994 | Taylor et al. | |
| 5,352,957 A | | 10/1994 | Werner | |
| 5,406,176 A | | 4/1995 | Sugden | |
| 5,414,328 A | | 5/1995 | Hunt et al. | |
| 5,455,490 A | | 10/1995 | Callahan et al. | |
| 5,530,322 A | | 6/1996 | Ference | |
| 5,621,282 A | | 4/1997 | Haskell | |
| 5,646,490 A | | 7/1997 | Carson et al. | |
| 5,769,527 A | * | 6/1998 | Taylor et al. | 362/85 |
| 5,854,541 A | | 12/1998 | Chou | |
| 5,920,156 A | | 7/1999 | Carson et al. | |
| 5,936,362 A | | 8/1999 | Alt et al. | |
| 6,020,825 A | | 2/2000 | Chansky et al. | |
| 6,169,377 B1 | | 1/2001 | Bryde et al. | |
| 6,175,201 B1 | | 1/2001 | Sid | |
| 6,175,771 B1 | | 1/2001 | Hunt et al. | |
| 6,211,626 B1 | | 4/2001 | Lys et al. | |
| 6,249,091 B1 | | 6/2001 | Belliveau | |
| 6,300,727 B1 | | 10/2001 | Bryde et al. | |
| 6,459,938 B1 | * | 10/2002 | Ito et al. | 700/9 |
| 6,517,216 B1 | * | 2/2003 | Cercone et al. | 362/220 |
| 6,548,967 B1 | * | 4/2003 | Dowling et al. | 315/318 |
| 6,597,132 B2 | * | 7/2003 | Hunt et al. | 315/316 |
| 6,605,907 B2 | * | 8/2003 | Belliveau | 315/294 |

* cited by examiner

*Primary Examiner*—Y. My Quach-Lee
*Assistant Examiner*—Peggy A. Neils
(74) *Attorney, Agent, or Firm*—Notaro & Michalos P.C.

(57) ABSTRACT

A controller for a lighting system is integrated with a light or other device. The controller operates in a local mode to control the integrated light only and in a remote mode to function as a serial network protocol controller for a series of connected devices. In remote mode, an IR/RF remote control is used to change settings for any device connected to the controller. The controller generates a fast serial network protocol instruction sequence, such as a DMX-512 protocol instruction sequence, from the commands received relatively slowly from the IR/RF remote control. The controller can include an hours of operation counter for the integrated light and a global setting function for changing all connected devices simultaneously to a single setting.

36 Claims, 5 Drawing Sheets

CONTROLLER PANEL AND SYSTEM FOR LIGHT AND SERIALLY NETWORKED LIGHTING SYSTEM

FIELD AND BACKGROUND OF THE INVENTION

The present invention relates generally to the field of fluorescent lighting and in particular to a new and useful controller for selectively controlling a series of connected fluorescent lights to produce different lighting effects, such as in a photographic or film studio.

Lighting systems used in photographic studios, film studios, location shots, television sets and live theater stage productions are often elaborate and include many different lighting devices and effects devices to produce a desired lighting combination. Most often, however, these lights are incandescent, rather than fluorescent.

Until recently, fluorescent lighting produced a noticeably different light, or different color temperature, than conventional incandescent lamps. Fluorescent lamps can now be made which produce light suitable for use in a variety of situations, including photographic studios, film studios, location shots and television studios.

As a result, fluorescent lighting is becoming more popular for use in lighting for photography, television studios and film studios. Fluorescent lighting differs from incandescent lighting most notably in that fluorescent lights include a ballast which generates the necessary power from supplied power to energize gas in each lamp tube and create a visible discharge. Unlike an incandescent lamp, the amount of power received by a fluorescent lamp is not linearly proportionate to the brightness output of the lamp. That is, a power setting of 50% of maximum does not necessarily produce a brightness output of 50% of maximum for a fluorescent lamp.

In recent years, many different aspects of lighting systems have been computerized to improve the ease and speed with which a lighting program for a particular stage show can be set up. The difficulty experienced when attempting to dim or otherwise control fluorescent lamps compared with incandescent lamps has been a primary reason why fluorescent lighting systems are not used in these systems.

While many different control systems are available for controlling complex lighting arrangements, one protocol which is generally accepted for use in theater lighting in particular is the DMX-512 protocol. DMX-512 protocol refers to a protocol standard as defined by the United States Institute for Theatre Technology, Inc. (USITT).

Presently, a DMX-512 protocol controller has up to 512 channels transmitted serially to each of any number of connected lighting system devices. Known devices each contain a manually set address circuit which identifies the particular channel or channels that the device will take instructions from the DMX-512 controller. Each of the DMX-512 controller channels has multiple levels, or amplitude settings, to produce different conditions in the connected lighting devices, whether they be dimmers, color mixers, etc.

The DMX-512 protocol used in a DMX-512 protocol controller is described in a United States Theatre Technology, Inc. (USITT) publication entitled, "DMX512/1990 Digital Data Transmission Standard for Dimmers and Controllers." The protocol is a network protocol having a central controller for creating stream of network data consisting of sequential data packets. Each packet initially contains a header for checking compliance with the standard and synchronizing the beginning of data transmission, which is then discarded. A stream of sequential data bytes representing data for sequentially addressed devices follows the header. For example, if the data packet contains information for device number 31, then the first 30 bytes after the header in the data stream will be discarded by device number 31 and byte 31 will be saved and used. When more than one byte of information is needed by a device, then its device number is its starting address and the number of required bytes after the starting address will be saved and used. The DMX-512 protocol uses a data stream of up to 512 bytes, excluding the header, each having hexadecimal values corresponding to decimal numbers from 0–255.

A drawback to the known lighting devices used with DMX-512 protocol systems is that the addresses of the devices must be set manually using DIP switches by a person having physical contact with the device. In order to change the address of a particular device, the DIP switches must be reset in the proper configuration for the new address.

However, U.S. Pat. No. 6,175,201, issued in the name of the inventor of this invention, discloses, among other things, a method for remotely programming the addresses of lighting control devices using a DMX protocol.

The DMX-512 protocol control system is discussed in connection with the lighting system taught by U.S. Pat. No. 4,947,302. The lighting system is programmable with intensity changes, movements, etc., but the addresses of the lamps and other devices are not programmable.

Other types of lighting systems with digitally addressable devices are known.

For example, a lighting system with programmable addressable dimmers is taught by U.S. Pat. No. 5,530,332, which discusses the problems associated with manually set addressable dimmers and teaches a dimmer which is addressed by first entering a program mode by depressing buttons. An address is then set in the dimmer memory by using a central controller to generate the address location data and send the address to the dimmer. The address location data is a binary word.

U.S. Pat. No. 5,059,871 teaches a lighting system in which individual lamp controllers may have their addresses programmed electronically from a central controller unit. When one of the lamp controllers is placed in a programming mode, a Master Control Unit (MCU) in the central controller unit is used to generate an identification (ID) for the lamp controller. The particular ID is set by incrementing or decrementing any channel on the central controller between 1 and 31. The ID value is shown in binary code on a LED display. The ID in the lamp controller is the address used to select the lamp(s) connected to the lamp controller. The lamp controller may be a dimmer or on/off switch, for example.

A control system with programmable receivers for controlling appliances is disclosed by U.S. Pat. No. 5,352,957. The receivers may control lights, for example. The original addresses for the controlling receivers are initially set manually, but may be changed electronically once the receivers are connected to the control system. The addresses of the receivers are set automatically based on their positioning within the system, rather than by a person on an arbitrary basis.

U.S. Pat. No. 5,245,705 discloses a memory addressing system in which a central control unit sends a message signal with an address code to several attached devices over a bus interface. Devices which are encoded to accept the address code respond to the message signal. At column 6, lines 3–8, this patent indicates that the functional addresses recognized by a device may be changed using a control message. The memory addressing system is not specifically for a lighting system, but rather, is for use in a general data processing system.

Lighting systems using addressable lamps controlled by computers are also known in the prior art.

U.S. Pat. No. 5,406,176 teaches a lighting system controlled by a personal computer. The computer can address individual lamps which have pre-programmed addresses. However, changing the addresses of the lamps using the computer is not taught.

U.S. Pat. No. 4,392,187 discloses a console-controlled lighting system having addressable lights of the manual set type. The electronic address of each light is set using manual thumb switches. The console sends instructions which are interpreted by the light to which they are addressed.

A series of lighting cues can be programmed and stored in memory in each lamp of the lighting system disclosed by U.S. Pat. No. 4,980,806. The different lighting cues, or setups, can be recalled by a signal sent from a central controller. The electronic addresses of the individual lamps are not changed using the controller.

U.S. Pat. No. 5,072,216 discloses a track lighting system having individual lights with manually set address switches contained in the light housings.

While the prior lighting systems are useful, they lack features which are necessary for working with fluorescent lighting and simplify controlling multiple devices from a studio location versus a separate control room.

SUMMARY OF THE INVENTION

It is an object of the present invention to provide a controllable lighting system for fluorescent lights which includes dimming, on/off and mechanical movement controls.

It is a further object of the invention to provide a lighting control system having a multiple-mode controller for a light or other studio device for alternately controlling the light and other devices connected in series with the light.

Yet another object of the invention is to provide a control system using a slow infrared remote control to drive a fast serial network protocol for controlling a network of connected devices.

A further object of the invention is to provide a lighting control system which is easily accessible by multiple users from different remote locations.

Accordingly, a lighting control system of the invention has a light with an integrated multi-mode controller having a serial network protocol, such as DMX-512, output and an external infrared/radio frequency sensor. A remote control is provided for controlling the multi-mode controller from a distance. Keypad inputs are provided for controlling the multi-mode controller locally.

The light with the multi-mode controller can be connected to several other devices in series or parallel using the serial network protocol output, provided the other devices have a circuit for interpreting serial or parallel network protocol commands. The integrated multi-mode controller includes a dimming function for fluorescent lamps to smoothly dim the light output from full bright to dark despite the non-linear dimming curve of such lamps. Further, the light can be shut down remotely. The address of the lights can be changed remotely as well. The multi-mode controller includes an output for sending yoke control instructions to a motorized yoke for panning, tilting and changing the elevation of a device, such as the light, attached to the yoke.

In a preferred embodiment, multiple devices connected to the multi-mode controller are controlled using a network protocol, such as DMX-512, when the multi-mode controller is placed in that mode of operation. The multi-mode controller can effectively imitate a DMX-512 or other type of controller for any connected devices. The multi-mode controller operation can be handled using the remote control or from the multi-mode controller panel on the light. The remote control may transmit signals to the multi-mode controller more slowly than the multi-mode controller transmits to the connected devices, or they may operate at the same speed. That is, in one embodiment, a slow transmitting remote control may be used to control a high-speed network using the multi-mode controller.

In a second mode of operation, the multi-mode controller and remote control only control the operation of the single light or other device with which the multi-mode controller is integrated.

The several features of the multi-mode controller of the invention may all be accessed using either the remote control or the keypad.

A further feature of the light control system of the invention is a digital hours of operation counter for the lamps installed in the light having the multi-mode controller. Most lamps consistently produce light of a different color temperature after a certain number of hours of operation than when they are new. The hours of operation counter is used to indicate when the lamps in the light should be replaced. The hours of operation is displayed on an LCD or other digital display on the multi-mode controller. The hours of operation can also be displayed on display of the remote control. The digital display can be used to provide other information to a user as well, including dimming levels, current function selected and mode of operation indicator, among other things.

The information shown to a user in the digital display can be relayed to the remote control via a bi-directional link between the remote control and the multi-mode controller. The information may then be displayed on the remote control with a similar digital display as on the multi-mode controller, for example.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENTS

Figure 1:
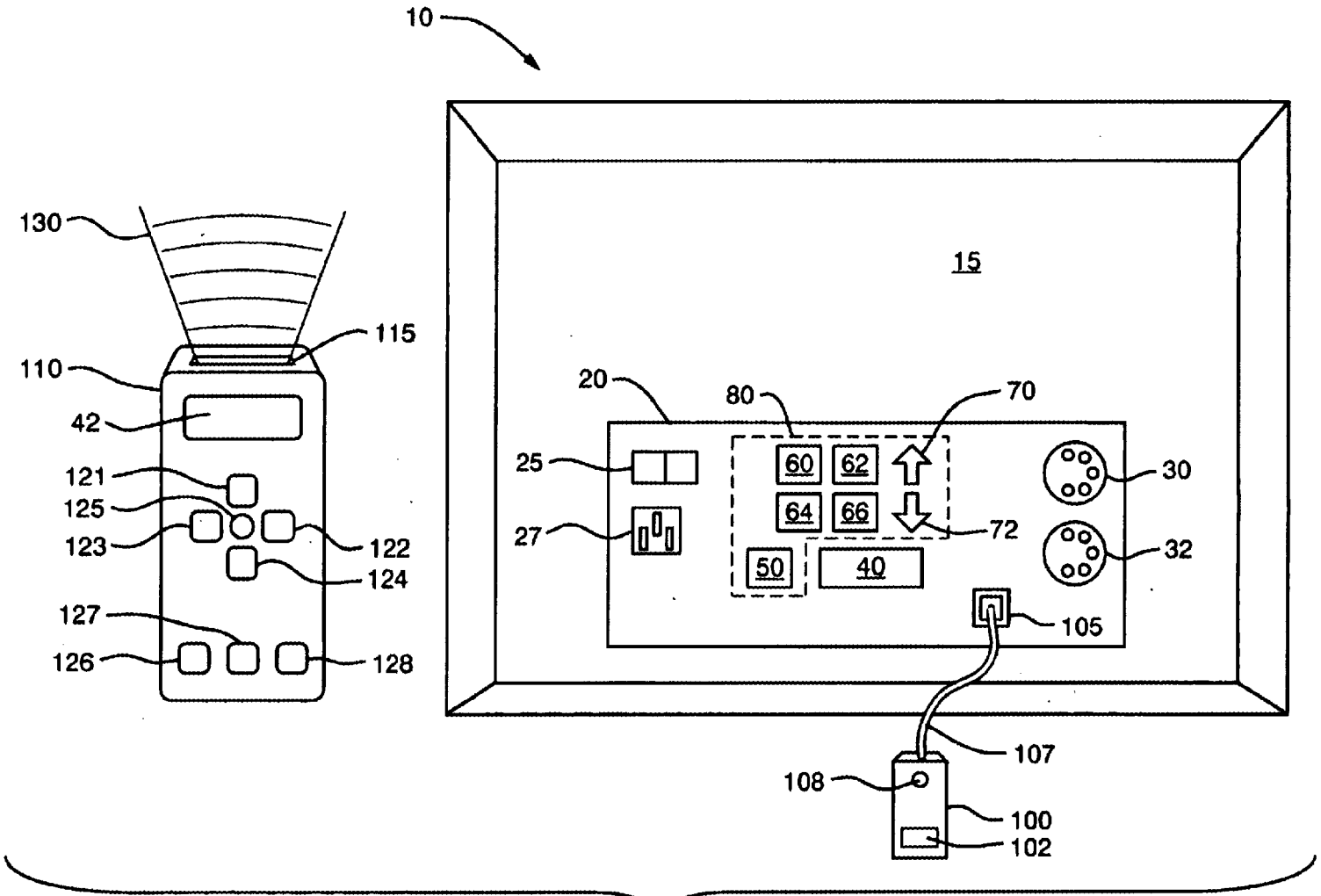
FIG. 1 is a perspective view of the basic components of the control system of the invention.

Referring now to the drawings, in which like reference numerals are used to refer to the same or similar elements, FIG. 1 shows a light 10 with an integrated multi-mode controller 20, connected infrared/radio frequency (IR/RF) sensor 100 and a remote control 110.

Multi-mode controller 20 is preferably located on the rear panel 15 of the light 10. Alternately, the controller 20 may be positioned in a side panel of the light 10. The light 10 includes one or more lamps (not shown) on the front of the casing for the light 10. When the controller 20 is included on the rear panel 15, it does not interfere with the operation of the lamps.

The multi-mode controller 20 has a two-position power switch 25 and a power inlet 27 for connecting to a standard wall outlet or other similar power supply using a known type of power cord. The controller also provides power to the lamps of the light 10, so only one power connection at power inlet 27 is needed.

A digital display 40 is provided for giving feedback to a local user of the controller 20 about the status and different commands being executed. The digital display 40 may be an LCD or other display which at least shows text messages, although a more complex display with graphics and color capability can be used. For example, the display can show various pieces of information about the light, including hours of operation and the address of the light on the control network, among other things.

The multi-mode controller 20 has a keypad 80 which includes four memory buttons 60, 62, 64, 66 and two selector arrow buttons 70, 72. The keypad may include more or fewer memory buttons 60–66, as desired. Depending on the mode of operation, the selector arrow buttons 70, 72 are used to increment and decrement dimming levels of the light. The memory buttons 60–66 can be used to store up to four different dimming levels for rapid recall, rather than using the arrow buttons 70, 72 to set the level.

A mode switch 50 is used to change the controller 20 between modes of operation. The multi-mode controller 20 is operated in either a local control mode or in one of two serial network protocol modes. Pressing the mode switch 50 toggles between modes. The mode can be changed between an IR/RF operated, or remote, mode, a local control mode and a serial network protocol external console, or slave, mode. The mode of operation can also be changed using remote control 110.

In a preferred embodiment of the local control mode, instructions to the controller 20 only affect the light 10 in which the controller 20 is integrated. The instructions are limited to setting the dimming level and storing the current dimming level in memory or retrieving the level from memory. The address of the light 10 can be changed, and an hours of operation counter can be reset when changing lamps as well. In alternative embodiments, the local control mode permits controlling other functions described below in connection with the serial network modes in addition to the dimming, memory, address and counter functions.

In the first serial network protocol mode, or slave mode, the controller 20 is inactive and the light 10 receives all instructions from a remote serial protocol console (not shown) through a serial network physical connection based on a device address of the light 10. For example, a remotely located DMX-512 control console could be used to control light 10 and several other devices daisy-chained in series with the light 10 by sending instructions to the devices based on their network addresses.

In the second serial network protocol mode, or remote mode, the controller 20 functions as the console for generating serial repeating sequentially addressed instructions to any devices connected in a serial network with the controller 20 and having a valid network address. Preferably, the serial network protocol is DMX-512. Connected devices can have a network address corresponding to any one of the 512 available DMX-512 channels and receive instructions on that channel. Devices with multiple features or settings may have multiple addresses so that each feature can be adjusted using the controller 20.

Although the serial network protocol mode is preferably controlled using the remote control 110, as will be explained further below, additional console controls can be included on the multi-mode controller 20 at the light 10 to permit operation like a console using controller keypad 80.

As will be explained further below, in the remote mode, the remote control 110 can be used to access all of the functions of the multi-mode controller 20 at a distance. That is, a user may operate the multi-mode controller 20 to control any connected device using only the remote control 110.

The controller has a serial network input port 30 and a serial network output port 32 for communicating with other devices using a serial network protocol, such as DMX-512. A new version of the DMX-512 protocol is presently being developed that will have similar features. The new version is tentatively known as DMX-512-A. Other serial protocols of note include ART-NET, an ethernet protocol. Although DMX-512 is a preferred protocol, as used herein, DMX-512 is intended to include other controller protocols having similar characteristics.

As described above, when controller 20 is in slave mode, the light 10 may be connected in series to other serial network protocol-controllable devices using input and output ports 30, 32 and operated remotely from a console. Alternatively, the controller 20 may be placed in serial network protocol remote mode using the local mode switch 50 or the remote control 110 from a distance. The controller 20 then acts as the serial network protocol controller for the remaining devices in the serial chain, using commands received from a remote control 110.

Remote control IR/RF sensor 100 is connected via a flexible cord 107 to a jack 105 in the controller 20. The IR/RF sensor 100 has an IR/RF receiver 102 for receiving infrared or radio frequency signals 130 being transmitted by remote control 110 to the controller 20. An LED indicator lamp 108 is optionally provided to show the status of the sensor 100, such as to visually confirm reception of a signal from remote control 110, since IR signals 130 require a line of sight to transmit and receive. Valid RF signal reception can be indicated by the lamp as well, although line of sight is not required for operation.

The remote control 110 is preferably a hand-held device for transmitting infrared (IR) and/or radio frequency (RF) signals 130 to the IR/RF sensor 100 connected to the controller 20. The remote control 110 can be used to operate the controller 20 in either local or remote modes using the several keys 120–128 on the remote control 110. In an even more preferred embodiment, the remote control 110 and IR/RF sensor 100 are part of a bi-directional link which permits sending and receiving by each device, so that commands and data (e.g., confirmation of receiving a command or information display) may be exchanged between them.

The remote control 110 includes a display window 42 to show a user what functions are being accessed and which instructions are being sent to the controller 20. The keys 121–128 on the remote control 110 preferably include level increment and decrement keys 121, 124, address increment and decrement keys 122, 123, a set or enter key 125, a power key 126, a mode key 127 and a global select key 128.

The remote control 110 has a network function for operating the controller 20 to control any device connected to the controller network, and a unit function for operating only the light 10. The remote control 110 can be used for either function, depending on the keystrokes used to signal the controller 20.

When the unit function of the remote control 110 is used to operate only the light 10, the level increment and decrement keys 121, 124 are used to brighten or dim, respectively, the light output by the light 10. Information about the light 10 can be obtained for display on the remote display 42, including the hours of operation counter value, the network address and brightness setting, among other things.

When the network function is used, the remote control 110 sends serial network protocol commands, such as DMX-512 commands via IR or RF signal to the controller 20. The remote control 110 can be used to manually change the controller 20 operation mode to remote mode using mode key 127. The controller 20 determines whether a device address transmitted by the remote control 110 with the dimming level command corresponds to the address for the light 10 or to a different device. If the address is different than that of the light 10, the controller 20 decodes the device address and dimming level setting and stores them in memory for transmission as part of a serial network protocol control signal by the controller 20. The remote control 110 is used to set any device connected to the multi-mode controller 20 on the network. Once a user is done setting any connected devices, the remote control 110 can then be used to transfer control of the network system back to the local or slave modes for continued operation using the settings.

Once the multi-mode controller 20 is placed in remote mode, the remote control keys 121–128 are used to select particular device addresses using address keys 122, 123 and set levels using level increment and decrement keys 121, 124 and set key 125. If the selected device address is that of the light 10, then the dimming function is accessed. The power key 126 can be used to turn the controller 20 or the addressed device on and off. Global select key 128 will direct the controller 20 to send the following instructions to all addresses on the network, so that any connected device will receive the same instruction, such as to dim all connected lights to 40% of their maximum.

Figure 2:
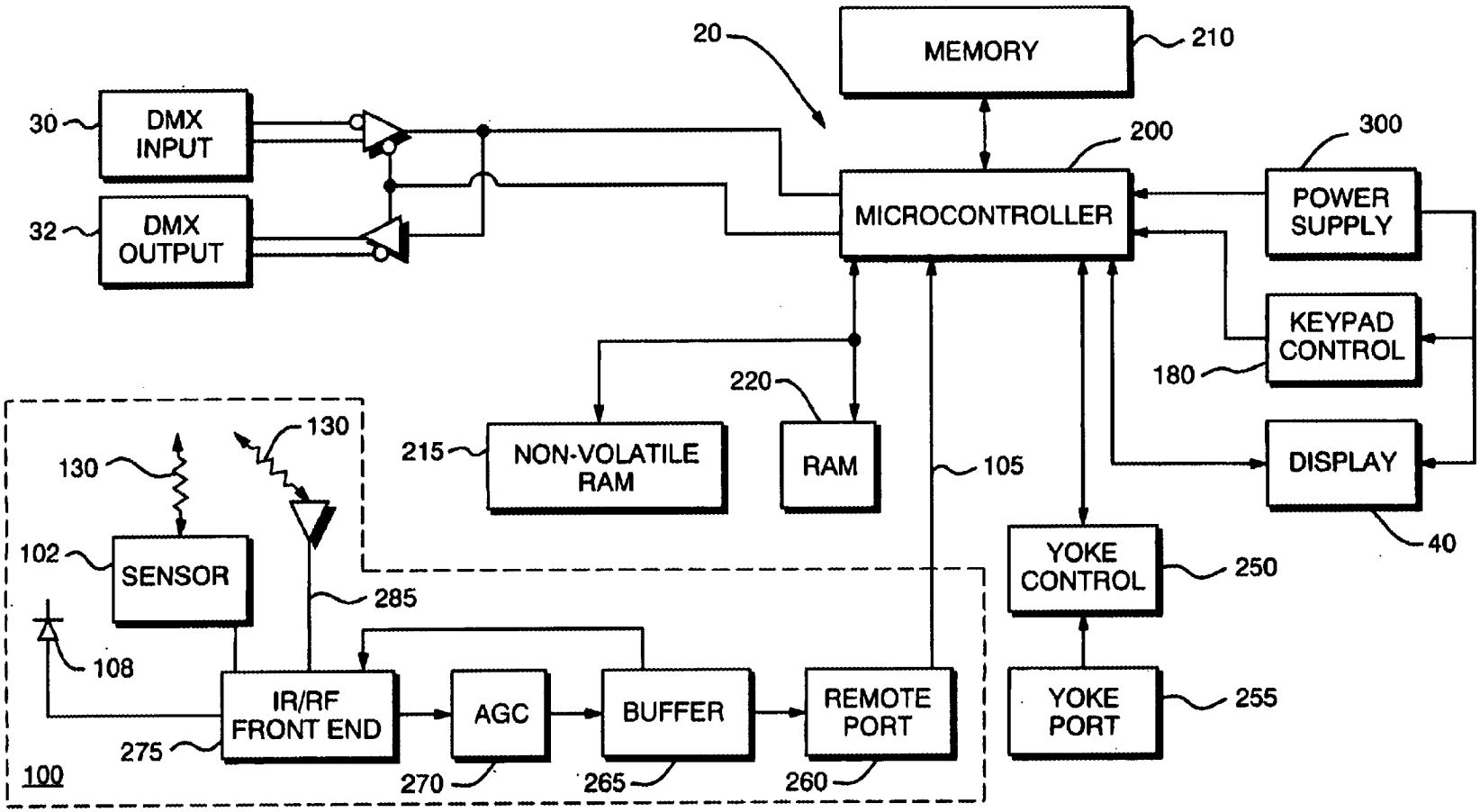
FIG. 2 is a block diagram of the components in a controller of the invention.

FIG. 2 is a block diagram showing the components of the multi-mode controller 20. Microcontroller 200 is the central processor, or CPU, for the multi-mode controller 20. A code, or program, memory 210, non-volatile RAM 215, and RAM 220 are connected to the microcontroller 200 for storing and retrieving instructions. Power is provided to the microcontroller 200 by a power supply 300. Power supply 300 also powers keypad control 180 and the display 40. Keypad control 180 interprets the keys pressed on the controller keypad 80 and transmits a corresponding signal to the microcontroller 200. The display 40 receives signals from the microcontroller 20 for showing messages to a user of the controller 20.

Serial network input and output ports 30, 32 are connected to the microcontroller 200 through a tri-state buffer circuit to prevent network protocol message collisions. The input and output ports 30, 32 are preferably DMX-512 input and output ports.

A remote port 260 is connected to the microcontroller 200 for receiving signals from the remote control 110. IR/RF signals 130 are received by IR receiver 102 and RF antenna 285 of the remote sensor 100 and communicated to an IR/RF front end 275 for signal conditioning. LED 108 is connected to the IR/RF front end 275 for indicating when a valid signal has been received. The IR receiver 102, RF antenna 285, LED 108 and IR/RF front end 275 may all be contained in the remote sensor 100, or the remote sensor 100 may only include the IR receiver 102 and/or the RF antenna 285.

The remote sensor 100 may be an external component, as shown, and physically connected to the light 10 and controller 20 at jack 105 to connect to remote port 260. Alternatively, the sensor 100 and its components can physically be built internal to the controller 20 or light 10 with the same connections between components 102, 108, 260–285. Power to the sensor 100 components is provided through remote port 260, so that no external power supply is required.

Depending on the signal type used, the RF antenna 285 or the IR receiver 102 may be eliminated if desired, as the system may be used with either type of remote signal transmitter/receiver, each having their own known benefits and drawbacks.

An automatic gain control (AGC) 270 is connected between the IR/RF front end 275 and a buffer 265. The AGC 270 is used to condition the signal before it is passed to the microcontroller 200. The AGC 270 boosts the signal if the IR/RF signal received is too weak to be interpreted by the buffer 265 and sends it back to the microcontroller 200. If the signal is too strong, which may saturate the input stages of the buffer 265, the signal is attenuated to acceptable levels. The AGC 270 is also useful for eliminating interference (e.g., noise), including ambient light when the IR link is used, or spurious RF signals from surrounding devices. The conditioned signal is then transmitted from the buffer 265 to the remote port 260. It should be noted that a similar AGC can be used in the remote control 110 for the same purpose, especially when bi-directional communication with the controller 20 is enabled.

The multi-mode controller 20 may include a yoke control 250 and yoke port 255 connected to the microcontroller 200. The yoke control 250 and yoke port 255 are used to direct physical orientation commands to the connected light 10 if a motorized yoke (not shown) is provided for rotating the light 10 about its vertical and/or horizontal axes (ie., pan and tilt), as well as the vertical position of the light 10. The mechanical positioning of the device using the yoke can be shown on display 40 to further assist a user. In a further embodiment, a yoke could be provided to change the elevation of the light 10 or to retract the light 10, such as into a recess or simply away from the subject of illumination.

When a yoke is present, preferably another device address different from that of the light 10 is provided for each axis which is controlled. The same device address can be used for both with the understanding that both the light dimming level and yoke position will be set with the same command. When, as in the preferred embodiment, the yoke axes of movement and light 10 each have separate DMX channel addresses then the position and brightness of the light 10 can be set independent of each other.

As discussed above, a primary function of the controller 20 is to control the dimming level of a connected light 10. It is generally known that lights which have an electronic ballast, such as fluorescent lights, do not have linear relationships between the control applied voltage and light output level (light intensity emitted by the light).

Figure 3:
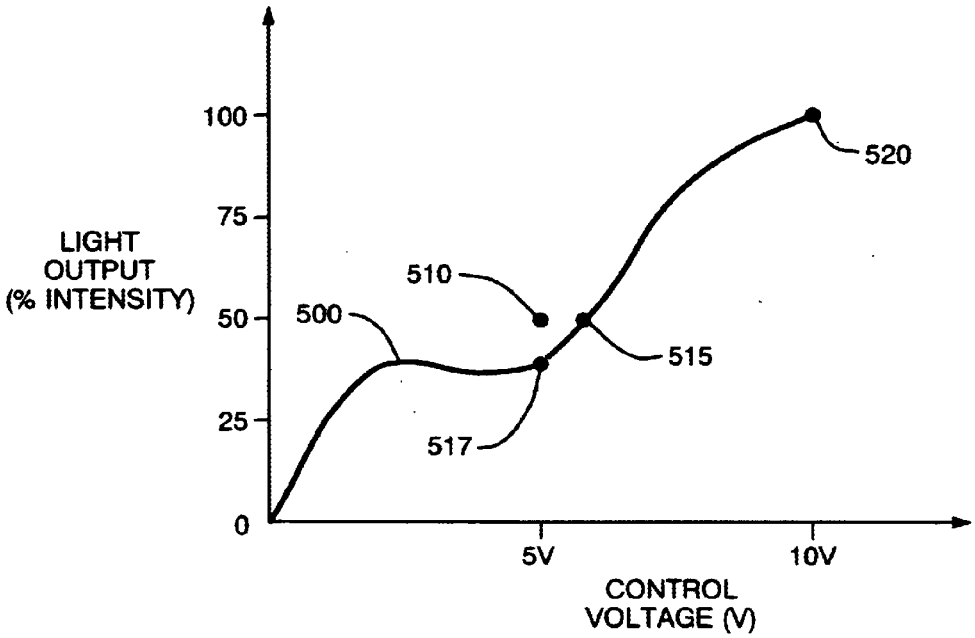
FIG. 3 is a graph plotting simulated data of percent of total intensity versus control voltage for a fluorescent lamp.

FIG. 3 illustrates a simulated dimming curve 500 for a fluorescent light. As shown, full brightness is achieved when 10 volts is applied to the light. However, a brightness of 50% is not produced by applying a voltage of 5 volts, or 50% of the full power 10 volts. Point 510 designates where the curve 500 should be if 5 volts produced a brightness of 50%. The curve 500 actually has a brightness of about 40% at 5 volts, indicated by point 517. A brightness of 50% is achieved for the light by applying about 6 volts, or 60% of full power, as indicated by point 515.

Thus, in order to overcome this obstacle, the controller 20 includes a lookup table programmed into the code memory 210 connected to microprocessor 200. The lookup table is adjusted for a given light so that when a dimming level of 50% is requested, the correct voltage for applying that dimming level is supplied to the light. The microprocessor 200 receives the instruction to set the dimming level and uses the appropriate lookup table for the light 10 to set the power level supplied by a power stage (not shown) of the light 10.

Alternatively, instead of a lookup table, a linearization algorithm may be applied to the desired dimming level to determine the necessary applied voltage. The linearization algorithm can be stored in the code memory 210 for use by the microprocessor.

Figure 4:
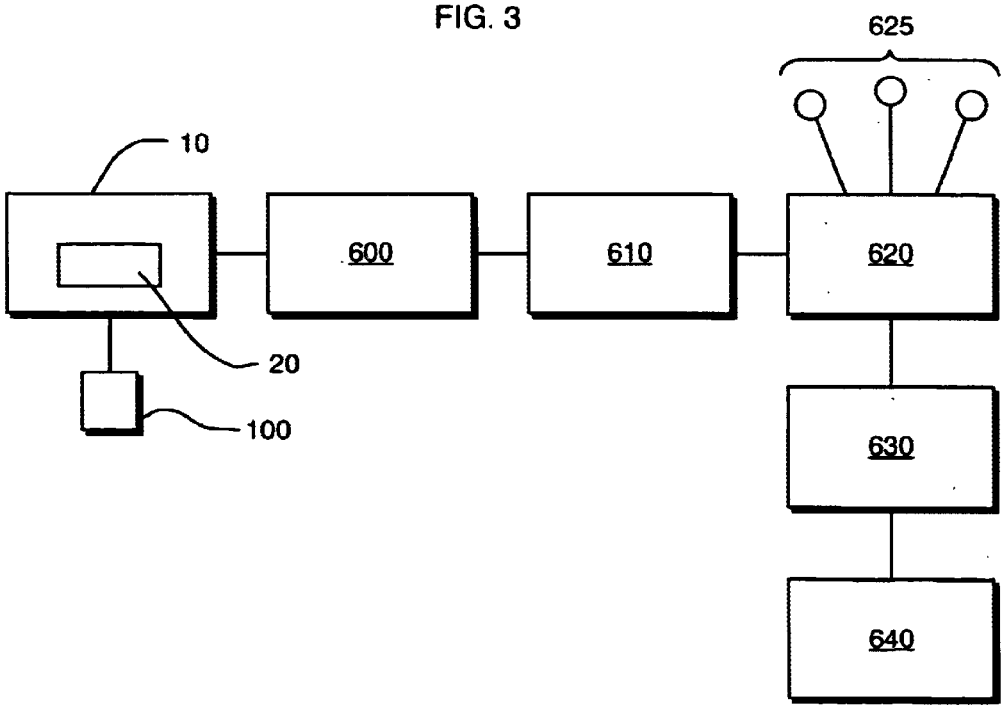
FIG. 4 is a block diagram of multiple components connected together and controlled using a controller of the invention in serial network protocol mode.

A significant benefit of the controller 20 is the ability to function as a serial network protocol console for a series of connected devices. As seen in FIG. 4, the light 10 with controller 20 and remote sensor 100 are connected in series with several other devices 600–640, each of which can be given a unique serial network address and controlled using the remote control 110 and controller 20. The devices may include a second light 600, a fogger 610, a dimmer 620 having several lights 625 connected to it, a fan 630 and color scroller 640. Each serially connected device can be given a unique network address for receiving instructions from the controller 20 operating in remote mode. For example, when the network protocol is DMX-512, the network address can be any one of the 512 available channel addresses.

Other devices that can be connected to the daisy chain include flashes, shutters, dimmer banks, gobo wheels and other devices controllable by a serial network protocol that are used in film, photographic and television studios.

The remote control 110 can be used to generate commands for connected devices 10, 600, 610, 620, 630, 640 using a relatively slow IR or RF signal which is transmitted to the IR/RF sensor 100 and decoded by controller 20. The controller 20 subsequently generates and transmits a relatively fast serial network protocol signal containing the instructions for each addressed device in the daisy-chain.

For example, when DMX-512 protocol is used, the controller 20 decodes the transmitted commands in an IR/RF signal 130 from the remote control 110 into instructions on one or more of the 512 available channels to serially transmit to the serially connected devices. Thus, the controller 20 is effectively a built-in DMX-512 console controller which is located in the same room as the devices it is connected to and can be operated from nearly anywhere in the room, subject to signal reception between the remote control 110 and IR/RF sensor 100. The ability to directly control all connected devices 10, 600, 610, 620, 630, 640 with the integrated controller 20 simplifies the task of setting each device, for instance, for the director or photographer of the studio where the devices 10, 610, 620, 630, 640 are being used. Also, multiple remote controls 110 can be used with the same controller 20 so that different people in the studio can each change settings for the devices 10, 610, 620, 630, 640.

It should be noted that the remote control 110 and each of the networked devices 10, 610–640 can all be connected together using wireless communications, or some components may be connected with wires, while others are wireless. As described above, the wireless communication is preferably via IR and RF signals. Preferably, the remote control 110 is a wireless device only, so that a user may be anywhere in an operating vicinity of the networked devices 10, 600–640 connected to a multi-mode controller 20 in order to operate the devices 10, 600–640 from any point in the operating area. Clearly, the operating area will be determined by the type of control signal (IR, RF or other) used.

The global setting function of the remote control 110 and controller 20 accessed with the global setting key 128 is particularly useful when the connected devices 10, 600, 610, 620, 630, 640 are all lights. In such case, the same setting is quickly applied to all of the connected devices, such as to immediately dim all connected lights to 20% of full brightness or immediately raise all connected lights to 90% of full brightness, while once the global setting is exited, the controller 20 can return all devices back to their last individual setting. The global setting key 128 indicates to the microcontroller 200 that the next commands should go to all devices. Accordingly, the microcontroller 200 then uses two different memory buffers in the memories 215, 220 to store the global level setting and the current settings of each device. The microcontroller then generates the global setting serial network protocol instructions with the single setting on each channel and subsequently transmits the multi-channel instruction stream to the connected devices.

In a further embodiment of the controller 20, the microcontroller 200 includes an hours of operation counter for the lamps in the light 10. The number of hours that a particular lamp in the light 10 has been in use can be recalled from a stored location in non-volatile memory 215 and shown on display 40 to a user. The number of hours a particular lamp has been in use is important because the color temperature of the lamp will change over time for most types of lamp. The controller 20 may contain an alarm to alert a user when the hours of operation for a lamp have exceeded a recommended usage period. The alarm can be a flashing display or causing the lamp to flash. The counter can be reset when the lamps are changed. Alternatively, the alarm message may be sent automatically to the remote control 110 using bi-directional communication with the controller 20. In a further embodiment, a user may poll each device 10, 610–640 in the network having lamps to obtain the statistics on either the controller display 40 or remote control display 42. Preferably, non-volatile RAM 215 is used to store the hours of operation counter values.

It should be noted that the light 10 described herein is preferably a fluorescent light, but the controller 20 can be used with any other type of light as well, including incandescent, tungsten, HMI, LED and especially others which require an electric power supply.

The controller 20 is particularly well suited for use in a small studio or for video conferencing applications. A single person may use the remote control 110 and a device having controller 20 to operate several lights or other components while remaining in a single position, such as seated in front of a video camera connected to a computer network for communications.

Figure 5:
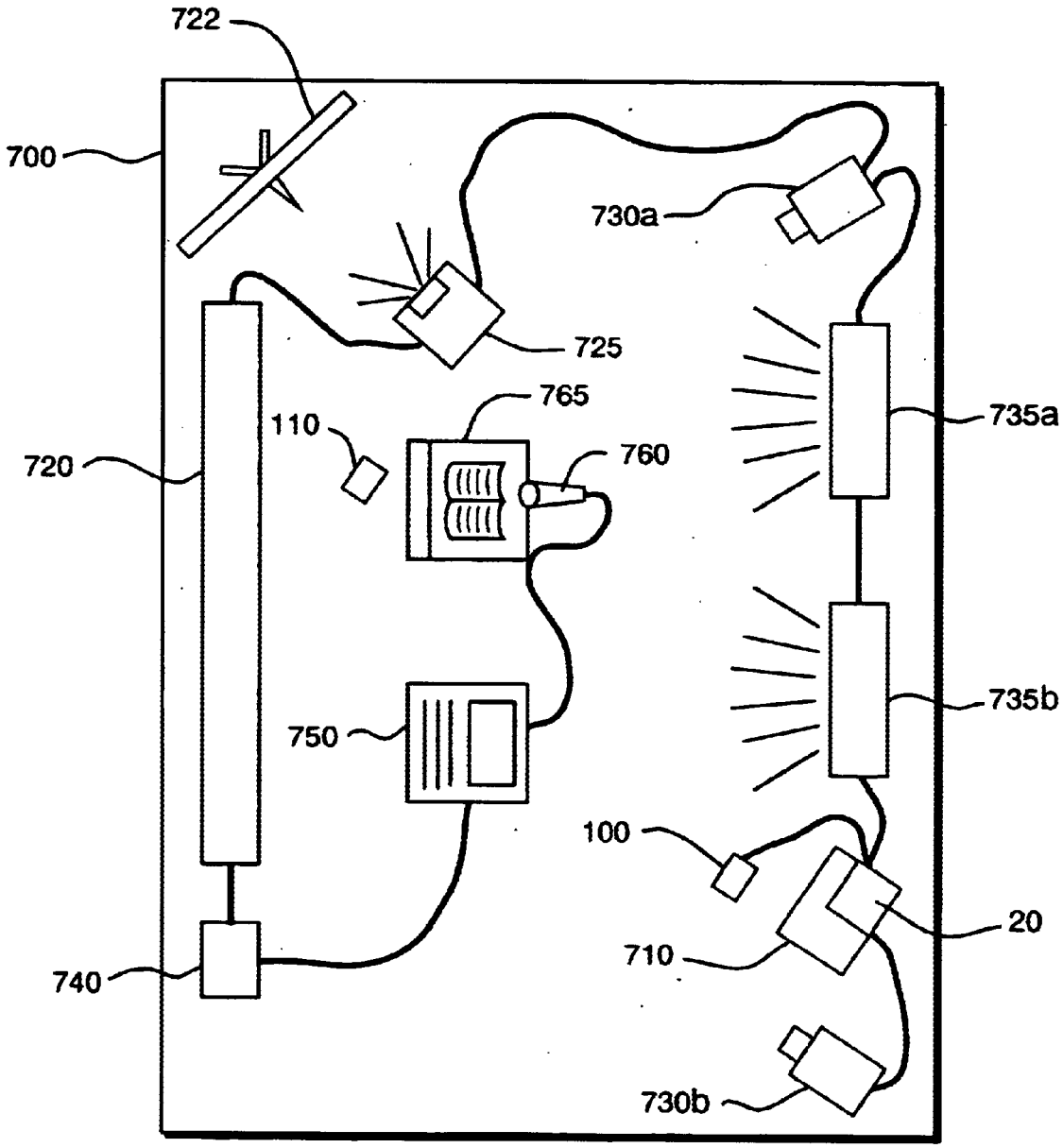
FIG. 5 is a top plan view diagram of a distance learning studio using a controller of the invention.
Figure 6:
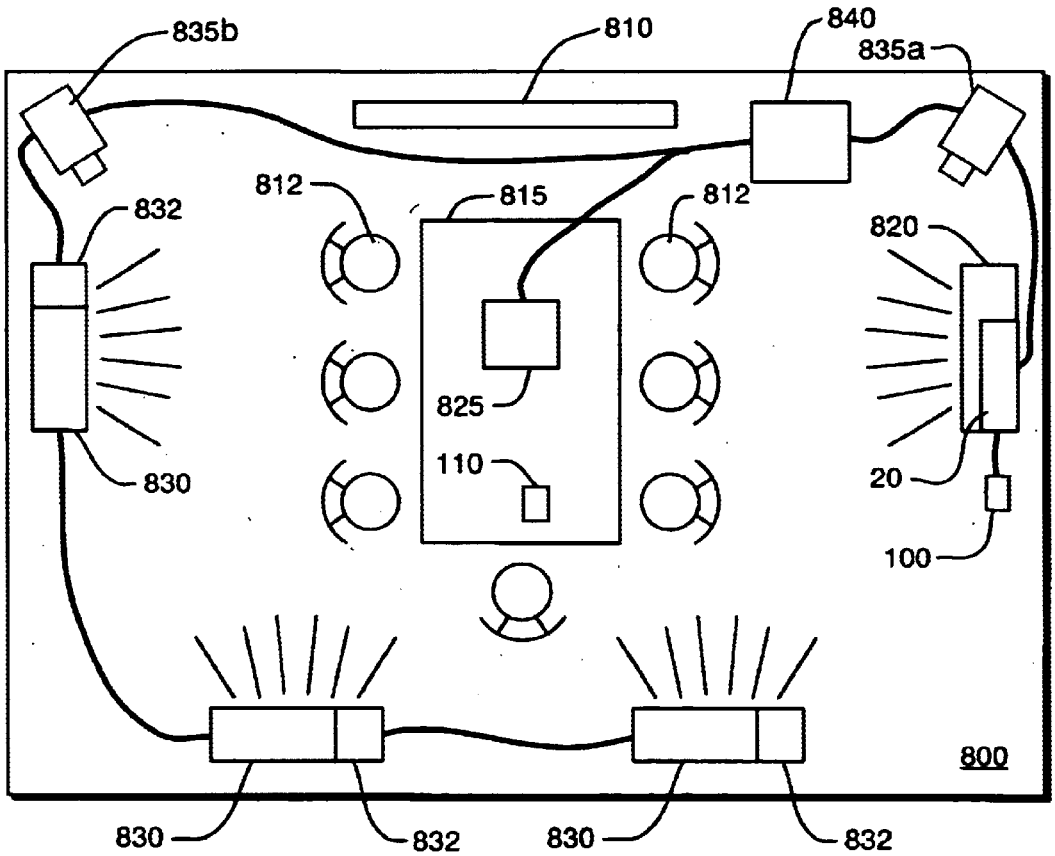
FIG. 6 is a top plan view of a conference room for video-conferencing using a controller of the invention.

FIGS. 5 and 6 illustrate two different video conferencing applications using the controller 20 and a variety of connected devices.

In FIG. 5, a distance learning studio 700 has a podium 765 positioned to be seen by cameras 730*a*, 730*b* and illuminated by lights 720, 735*a*, 735*b*. A microphone 760 is mounted on the podium 765 for picking up speech from a lecturer. A computer 750 is provided for receiving messages for the lecturer from students attending the session remotely. An overhead, slide or computer-driven projector 725 is provided and displays images on screen 722, which can be captured and transmitted by cameras 730*a, b*. A stereo 740 is provided for playing music in the background or as a teaching tool.

A control light 710 having a controller 20 is provided in the studio 700 in a location where remote sensor 100 is visible for IR transmissions or within range of RF transmissions from the podium 765. Thus, a remote control 110 can be used by a lecturer at the podium 765 to operate the controller 20.

The various lights 720, 735*a, b*, cameras 730*a, b*, stereo 740, projector 725, microphone 760 and computer 750 are all connected together in series with the control light 710 for communication using a serial network protocol. Each device 710, 720, 725, 735*a*, 735*b*, 740, 750, 760 is addressable with a serial network protocol and has at least one serial network protocol controllable function. These devices all receive instructions from the controller 20 in control light 710. The controllable functions of each device will depend on the device.

For example, the lights 710, 720, 735*a*, 735*b* can all be dimmed, or if they are connected to yokes, then they can be panned, tilted and/or raised and lowered. Similarly, the cameras 730*a, b* may be pan, tilt, zoom, or PTZ, cameras as they are known in the art, that can be manipulated in accordance with their descriptive name. The projector 725 may be turned on and off or the image being displayed can be advanced to the next in sequence. Stereo 740 can be turned on and off, muted or a different audio track selected. Microphone 760 can be muted or amplified and computer 750 can be controlled to switch to transmit the monitor image in place of images from cameras 735*a, b*.

The commands for each device function are sent using the remote control 110 and controller 20 as described above.

FIG. 6 illustrates a video conferencing room 800 having a wall monitor 810 positioned for viewing by participants seated in chairs 812 at conference table 815. A speaker phone 825 is positioned on table 815 for delivering and transmitting audio to and from the participants, while images of remote conference participants are shown on the monitor 810. The speaker phone 825 includes a microphone to pick up and transmit audio from the local participants.

Dimmable fluorescent lights 830 mounted on controllable yokes 832 are positioned around the room 800 to provide different lighting levels. The yokes 832 are used to change the pan, tilt and elevation of each light 830.

PTZ cameras 835*a*, 835*b* are provided for transmitting images of the local video conference participants at the table 815.

A sound system 840 can be used as an alternate source for playing audio signals received by the video conference through speaker phone 825, and, as well, to play background music or other audio.

Control light 820 has an integral controller 20 with a remote sensor 100. The remote sensor 100 receives signals from remote control 110, as described above. The lights 830, cameras 835*a, b*, sound system 840 and speaker phone 825 are all connected in a network with the control light 820 using a serial network protocol. The controller 20 is used to operate the connected devices using serial network protocol signals based on commands received through the remote sensor 100 from the wireless remote control 110, as described above, and to perform similar functions to those described with respect to FIG. 5.

The speaker phone 825 can be controlled using the controller 20 to increase or decrease the volume of received audio, or to switch the audio signal off and receive it through the sound system 840. Similarly, the sound system 840 can be controlled to change the volume, change the input source and turn the power on and off.

While a specific embodiment of the invention has been shown and described in detail to illustrate the application of the principles of the invention, it will be understood that the invention may be embodied otherwise without departing from such principles.

What is claimed is:

1. A lighting control system comprising:

a light with at least one lamp;

a remote control having a remote keypad and signal means for transmitting a wireless remote control signal containing instructions;

a serial network output port;

at least one device connected in series to the serial network output port, each at least one connected device being addressable using a serial network protocol;

a controller contained within the light and connected to the light and to the serial network output port, the controller having a keypad including a mode switch for switching the controller between at least a local mode and a remote mode, the controller in the local mode being for changing the dimming level of the light, and the controller in the remote mode being for generating and transmitting a serial network protocol instruction signal to the light and each at least one connected device, the network protocol instruction signal containing device settings for the light and each at least one connected device, the device settings being changed using the remote keypad or the controller keypad;

linearization means in the controller for linearizing a dimming curve for the light to smoothly dim the light; end a sensor connected to the controller for receiving the remote control signal.

2. A lighting control system according to claim 1, wherein the linearization means comprises a linearization algorithm and look-up table corresponding to the at least one lamp in the light.

3. A lighting control system according to claim 2, wherein the at least one lamp comprises a fluorescent lamp.

4. A lighting control system according to claim 1, wherein the serial network protocol is DMX-512.

5. A lighting control system according to claim 1, wherein the controller comprises a microcontroller, a memory connected to the microcontroller, and a display driven by the microcontroller, the controller keypad and serial network output port each connected to the microprocessor.

6. A lighting control system according to claim 5, wherein the microcontroller includes counter means for counting the hours of operation of each at least one lamp in the light.

7. A lighting control system according to claim 6, wherein the at least one lamp comprises a fluorescent lamp.

8. A lighting control system according to claim 1 wherein the remote control signal is an IR/RF signal.

9. A lighting control system according to claim 8, wherein the serial network protocol is DMX-512.

10. A lighting control system according to claim 9, wherein the at least one lamp comprises a fluorescent lamp.

11. A control system for a studio or set location, the control system comprising:

a light having a housing and at least one lamp;

a serial network protocol controller integral with the light in the housing, the controller having at least two operation modes, the controller connected to the light for dimming each at least one lamp in the light in a first operation mode, the controller generating a serial network protocol control signal in a second operation mode;

a plurality of serial network protocol-controllable studio devices connected in a network with the serial network protocol controller for receiving serial network control signals, the plurality of serial network protocol-controllable studio devices each having a serial network protocol address and being selected from the group consisting of cameras, yokes, lights, projectors, sound systems, telephones, microphones, and computer; and linearization means in the controller for linearizing a dimming curve for the light to smoothly dim the light.

12. A control system according to claim 11, wherein the serial network protocol controller further comprises a sensor for receiving wireless signals from a remote control.

13. A control system according to claim 12, wherein the controller comprises a microcontroller, a memory connected to the microcontroller, and a display driven by the microcontroller, the controller keypad and serial network output port each connected to the microprocessor.

14. A control system according to claim 13, wherein the microcontroller includes counter means for counting the hours of operation of each at least one lamp in the light.

15. A control system according to claim 11, wherein the linearization means comprises a linearization algorithm and look-up table corresponding to the at least one lamp in the light.

16. A control system according to claim 15, wherein the at least one lamp comprises a fluorescent lamp.

17. A control system according to claim 11, wherein the controller further comprises a keypad and a display for operating the controller in either of the first and second operation modes.

18. A control system according to claim 17, further comprising a wireless remote control, the controller having a sensor for receiving a wireless signal from the remote control to operate the controller in either of the first and second operation modes.

19. A control system according to claim 18, wherein the wireless remote control includes a mode switch for changing between the first and second operation modes.

20. A control system according to claim 18, wherein the wireless remote control includes a keypad and a display for generating the wireless signal.

21. A control system according to claim 20, wherein the wireless signal is one of an infrared signal, an RF signal or a combination thereof.

22. A control system according to claim 20, wherein the wireless signal contains instructions for dimming the light used in the first operation mode and instructions for changing the serial network protocol control signal in the second operation mode.

23. A control system according to claim 22, wherein the remote control is used to generate a wireless signal for changing the serial network protocol signal for a particular serial network protocol address when the controller is operated in the second operation mode.

24. A control system according to claim 23, wherein the serial network protocol is one of DMX-512, DMX-512-A and ART-NET.

25. A control system according to claim 22, wherein the remote control is used to generate a wireless signal for simultaneously changing the serial network protocol signal for each serial network protocol address when the controller is operated in the second operation mode.

26. A control system according to claim 25, wherein the serial network protocol is one of DMX-512, DMX-512-A and ART-NET.

27. A control system according to claim 18, wherein the serial network protocol is one of DMX-512, DMX-512-A and ART-NET.

28. A control system according to claim 11, wherein the serial network protocol is one of DMX-512, DMX-512-A and ART-NET.

29. A control light for a lighting control system having at least a pair of serial network protocol-controllable devices each having a serial network protocol address connected together in a network, the control light comprising:

a housing;

at least one lamp held in the housing;

a serial network protocol controller mounted in the housing and electrically connected to the at least one lamp for dimming the at least one lamp in a first operation mode, the controller including linearization means for linearizing the dimming curve for the at least one lamp, the controller having a second operation mode for generating and transmitting a serial network protocol signal to each of the at least a pair of serial network protocol-controllable devices and the at least one lamp.

30. A control light according to claim 29, wherein the controller further comprises counter means for tracking a number of hours of operation for the at least one lamp.

31. A control light according to claim 29, wherein the lamp comprises a fluorescent lamp.

32. A control light according to claim 29, wherein the controller further comprises a remote sensor for receiving a wireless control signal.

33. A control light according to claim 32, wherein the wireless control signal is an RF signal, an IR signal or a combination thereof.

34. A control light according to claim 29, further comprising a keypad for operating the controller in each of the first and second operation modes.

35. A control light according to claim 34, wherein the keypad includes a switch for changing between the first and second operation modes.

36. A control light according to claim 34, further comprising a display on the controller.

* * * * *